US005785238A

United States Patent [19]

Tai

[11] Patent Number: 5,785,238

[45] Date of Patent: Jul. 28, 1998

[54] COMBINED PACKAGE AND REST FOR CHOPSTICKS

[76] Inventor: Daniel Tai, 1102 Hunter St., Lombard, Ill. 60148

[21] Appl. No.: 715,866

[22] Filed: Sep. 19, 1996

[51] Int. Cl.[6] ..... B65D 85/20

[52] U.S. Cl. ..... 229/103; 206/443; 211/70.1; 211/70.7; 248/174

[58] Field of Search ..... 248/174; 211/70.1, 211/70.7, 68; 229/103; 206/443, 756; 131/257

[56] References Cited

U.S. PATENT DOCUMENTS

| | | | |
|---|---|---|---|
| 1,163,110 | 12/1915 | Schack | 248/174 |
| 2,374,442 | 4/1945 | Lulham | 131/257 |
| 3,777,767 | 12/1973 | Wunsch | 131/257 |
| 4,488,641 | 12/1984 | Nishiguchi et al. | 248/174 |
| 4,573,570 | 3/1986 | Cortopassi | 248/174 |
| 4,746,010 | 5/1988 | Fournier | 229/103 |
| 4,858,863 | 8/1989 | Lin | 248/174 |
| 4,940,199 | 7/1990 | Hall | 248/174 |
| 5,411,141 | 5/1995 | Bounds | 211/70.1 |

*Primary Examiner*—Stephen P. Garbe
*Attorney, Agent, or Firm*—Jerry A. Schulman

[57] ABSTRACT

A package for eating utensils such as chopsticks is foldable into a rest upon which to support said utensils when not in use.

9 Claims, 1 Drawing Sheet

COMBINED PACKAGE AND REST FOR CHOPSTICKS

BACKGROUND OF THE INVENTION

The present invention relates generally to packaging for eating implements and, more particularly, to a package for chopsticks that can be converted into a chopstick rest to be used while eating.

Chopsticks are common and popular eating utensils, particularly with oriental food dishes. Most commonly, chopsticks are made from wood and are packaged in paper sleeves until used and,after use, are many times discarded.

When using chopsticks to dine, the tapered or narrowed tips of the chopsticks used to pick up the food being eaten necessarily gets covered with sauce and bits of food. In many restaurants, chopstick rests are provided upon which the chopstick tips may be placed in order to avoid soiling the tablecloth and to avoid picking up bacteria or dirt from the table surface. Such chopstick rests are often made from fine woods or porcelains and must be cleaned between uses, characteristics that make them economical to use in mainly the more expensive restaurants.

It would be advantageous to provide chopstick rests that are disposable. It would also be desirable to provide such rests together with the chopsticks in a single, individual package.

BRIEF DESCRIPTION OF THE INVENTION

The present invention resides in a packaging sleeve for chopsticks that, after the chopsticks have been removed, can be reconfigured into a disposable chopstick rest. In one preferred form of the invention, the sleeve is doubled back upon itself, the free ends of the folded sleeve are attached together and a crease is made to form a niche for the chopstick ends. In another preferred form of the invention, a portion of the sleeve is cut or torn away to form a scallop within which the chopstick tips are placed.

BRIEF DESCRIPTION OF THE DRAWINGS

These and further aspects of the present invention may be better understood upon considering the accompanying drawings, in which.

DETAILED DESCRIPTION OF THE DRAWINGS

Figure 1:
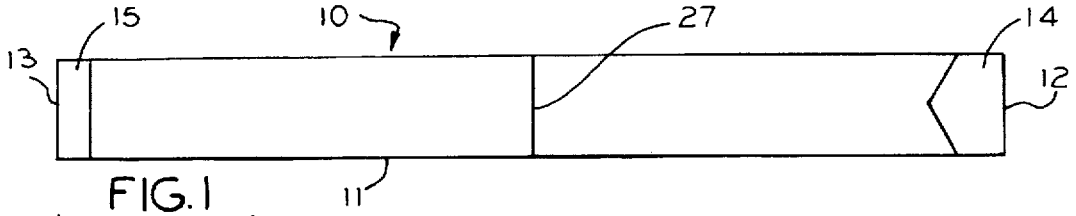
FIG. 1 (PRIOR ART)
FIG. 1 is a top plan view of an assembled prior art chopsticks sleeve/package.

Referring now to FIG. 1, the numeral 10 indicates generally a prior art package intended to hold a pair of chopsticks with the package consisting of a tubular sleeve 11 formed from paper or paper-like materials such as thin cardboard or Tyvek®, having a top 12 and a bottom 13 closed off, respectively, by a top flap 14 and a bottom flap 15. In normal use, top flap 14 may be glued or otherwise sealed to sleeve 11 and is peeled back to allow the chopsticks to be withdrawn therefrom. Once the chopsticks have been removed, package 10 is then typically discarded.

Figure 2:
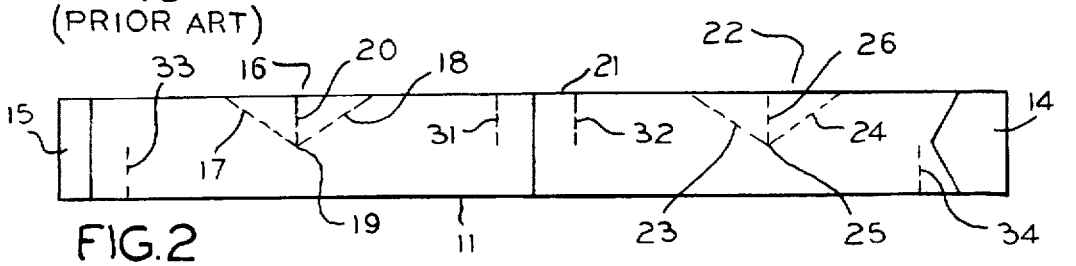
FIG. 2 is a top plan view of the sleeve of FIG. 1 modified according to the present invention, showing a set of crease lines and slits and slots thereon.

Referring now to FIG. 2, it can be seen that a set 16 of fold lines has bean added to sleeve 11. Set 16 has a pair of lines 17 and 18 meeting at an apex 19 to form a vee shape, and a line 20 which extends from apex 19 to top edge 21 of sleeve 11. In like fashion, a second set 22 of fold lines has a pair of lines 23, 24 meeting at an apex 25 to form a vee identical to that of set 16, and a line 26 extending from apex 25 to top edge 21. For sleeves formed of thinner material, fold line sets 16 and 22 may be printed or scribed on sleeve 11, while for sleeves of thicker material, fold line sets 16 and 22 may be scored into sleeve 11 to facilitate folding in a manner to be described below.

Figure 3:
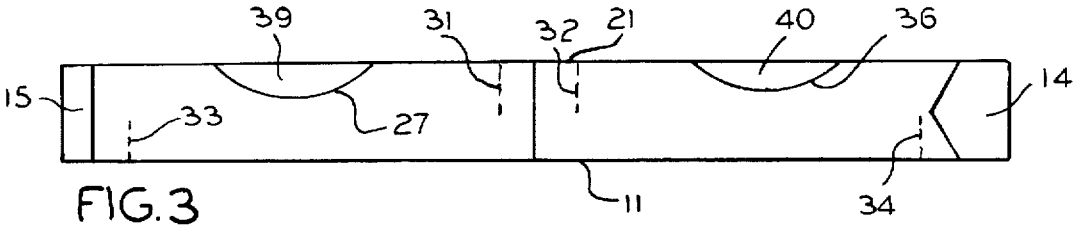
FIG. 3 is the sleeve of FIG. 2 showing a set of scallop lines thereon.

Referring now to FIG. 3, it can be seen that a pair of scallop lines 27 and 36 has bean added along top edge 21 of sleeve 11. Preferably, scallop lines 26 and 27 are scribed or drawn on sleeve 11, or may be scored or perforated for detachment and removal in a manner to be described below.

Figure 4:
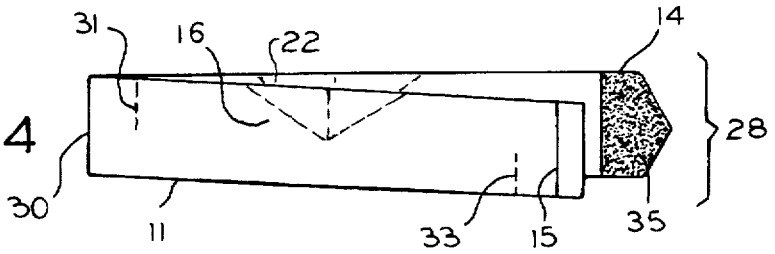
FIG. 4 is a view of the sleeve of FIG. 2 folded onto itself.

Referring to FIG. 4, sleeve 11 is shown folded across its longest or major axis at midline 30 such that top flap 14 and bottom flap 15 meet or overlap one another to form a free end 28. Folding sleeve 11 in this fashion also creates a fold end 30. The embodiment in FIG. 4 illustrates use of fold line sets 16 and 22, and demonstrates that when top flap 14 and bottom flap 15 overlap, sets 16 and 22 overlie one another or are in register with one another. In like fashion, scallop lines 27 and 36 overlie one another or are in register when sleeve 11 is folded as described above.

Figure 5:
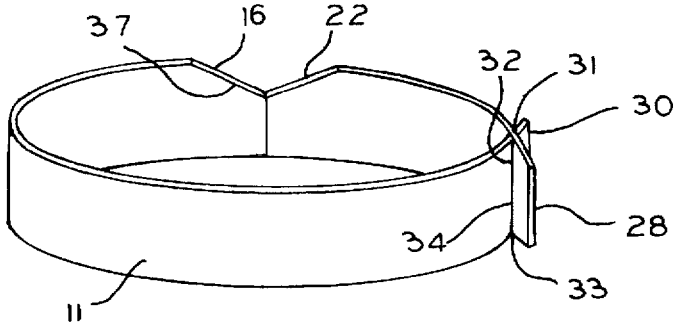
FIG. 5 shows the sleeve of FIG. 4 assembled into a chopstick rest with the free ends secured by slits-and-slots.

Referring now to FIG. 5, sleeve 11 is shown folded into a generally circular pattern to from a free-standing structure by bringing free end 28 together with fold end 30. In the embodiment of FIG. 5, ends 28 and 30 are fastened together using a slit-and-slot arrangement. As shown in phantom in FIGS. 2 and 3 a pair of slits 31, 32 are formed on sleeve 11 extending from top edge 21 approximately one-half the width of sleeve 11, with slits 31, 32 formed proximate to and on opposite sides of midline 29. Preferably, slits 31, 32 are formed by perforating sleeve 11, it being understood that sleeve 11 has front and rear walls and the perforations defining slits 31, 32 are formed through both walls. Slits 31 and 32 are thus formed by tearing sleeve 11 along the perforations.

In like fashion, a pair of slots 33, 34 are positioned along sleeve 11, with slot 32 positioned proximate top flap 14 and slot 34 positioned proximate bottom flap 15, with both slots extending generally upward from a lower sleeve edge 34. As with the slits described hereinabove, slots 33, 34 are formed by tearing sleeve 11 along a series of perforations. When sleeve 11 is folded over, both slits register one with another as do both slots, and the configuration shown in FIG. 5 is obtained when slits 31, 32 are aligned one with another and inserted into aligned slots 33, 34.

Figure 6:
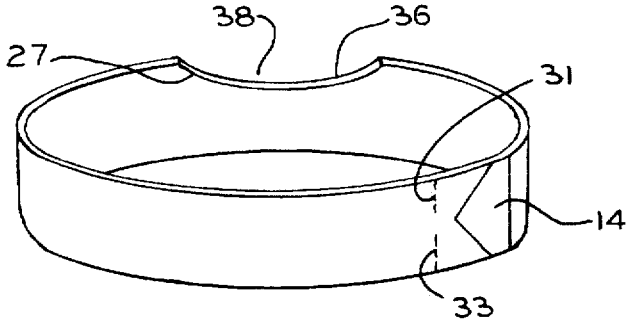
FIG. 6 shows the sleeve of FIG. 4 assembled into a chopstick rest with the free ends secured by adhesive strips.

Referring now to FIG. 6, another embodiment is shown in which sleeve 11 may be fashioned into a circular, freestanding pattern. In this embodiment, the underside 35 of top flap 14 is coated with a layer 36 of releasable adhesive of sufficient tack to hold flap 14 to sleeve 11 until it is desired to remove the chopsticks from package 10. Once sleeve 11 has been folded along midline 29, bringing fold end 30 and free end 28 together, top flap 14 is pressed to sleeve 11 as shown in FIG. 6.

Use of the present invention may now be described. When it is desired to remove the chopsticks held in package 11, top flap 14 is pulled away from sleeve 11, thereby opening package 10. After the chopsticks have been removed, sleeve 11 is first folded along midline 29, forming fold end 30. Next, fold end 30 is brought into contact with free end 28, forming sleeve 11 into a generally circular pattern. If the embodiment in FIGS. 2 and 5 is used, sleeve 11 is torn along the perforations forming slits 31, 32 and slots 33, 34, and said slits are inserted into said slots. If the embodiment in FIGS. 3 and 6 is selected, underside 35 of top flap 14, coated with releasable adhesive layer 36, is attached to sleeve 11 at fold end 30. Once sleeve 11 is formed into its circular, freestanding configuration, if the embodiment in FIGS. 2 is selected, with fold line sets 16 and 22 overlying one another, sleeve 11 is creased along fold lines 17, 18, 23 and 24 to form bight 37 on which said chopstick tips can be rested. If the embodiment in FIGS. 3 and 6 is selected, scallop lines 27 and 36, when aligned, are folded to form bight 38 on which said chopstick tips can be rested. In an alternative embodiment, scallop lines 27 and 36 are perforated sufficiently to allow flaps 39 and 40 to be removed to form bight 38.

While the foregoing has presented a description of certain preferred embodiments of the present invention, it is to be understood that these descriptions are presented by way of example only and is not intended to limit the scope of the present invention. It is expected that others skilled in the art will perceive variations which, while differing from the foregoing, do not depart from the spirit and scope of the invention as herein described and claimed.

What is claimed is:

1. A package, comprising:

a tubular sleeve having first and second ends;

a flap proximate said first end sized and shaped to overlap and close off said first end;

first and second edges extending between said first and second ends;

said sleeve having a midline intermediate said first and second ends and extending between said first and second edges;

said sleeve being foldable at said midline to form a fold end and to bring said first and second ends into registry with one another to form a free end;

means formed on said sleeve for attaching said free end and said fold end to one another to retain said sleeve in a generally circular pattern to form a freestanding structure; and means on said sleeve for forming a bight.

2. The apparatus as recited in claim 1 wherein said attaching means comprises first and second means for interengaging said first and second ends, said first interengaging means extending from said first edge proximate to one of said free end or said fold end, and said second interengaging means extending from said second edge and proximate the other of said free end or fold end.

3. The apparatus as recited in claim 1 wherein said attaching means comprises a layer of adhesive applied to said flap whereby said free end is secured to said fold end.

4. The apparatus as recited in claim 1 wherein said bight forming means includes at least one pair of fold lines extending in from one said edge to form a vee.

5. The apparatus as recited in claim 4 wherein said bight forming means comprises two said pairs of said fold lines, both said pairs extending from one said edge, both said pairs dimensioned and positioned on said sleeve to register one with another when said sleeve is folded at said midline.

6. The apparatus as recited in claim 1 wherein said bight forming means includes at least one scallop line extending in from and back out to one said edge to form a scallop.

7. The apparatus as recited in claim 6 wherein said bight forming means comprises two said scallop lines, both said scallop lines extending in from and back out to one said edge, both said scallop lines dimensioned and positioned on said sleeve to register one with another when said sleeve is folded at said midline.

8. A method for forming a freestanding rest for eating utensils from an elongated paper sleeve having first and second ends and upper and lower edges, said method comprising the steps of:

(a) forming at least one pair of fold line sets along said upper sleeve edge, said fold line sets sized and positioned to overlie one another when said sleeve is folded to bring said first and second ends together;

(b) folding said sleeve to bring said first and second ends together;

(c) securing said first and second ends together to form a generally circular freestanding structure resting on said lower sleeve edge; and (d) folding said sleeve along said fold line sets to form a bight for supporting said eating utensil.

9. The apparatus as recited in claim 2 wherein said first interengaging means comprises at least one slit and said second interengaging means comprises at least one slot.

* * * * *